US012553307B2

(12) United States Patent
Evers

(10) Patent No.: US 12,553,307 B2
(45) Date of Patent: Feb. 17, 2026

(54) EXPANDABLE METAL GAS LIFT MANDREL PLUG

(71) Applicant: Halliburton Energy Services, Inc., Houston, TX (US)

(72) Inventor: Rutger Evers, Addison, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 11 days.

(21) Appl. No.: 16/906,345

(22) Filed: Jun. 19, 2020

(65) Prior Publication Data

US 2021/0040810 A1 Feb. 11, 2021

(51) Int. Cl.
*E21B 33/12* (2006.01)
*E21B 43/12* (2006.01)

(52) U.S. Cl.
CPC ..... *E21B 33/1208* (2013.01); *E21B 33/1212* (2013.01); *E21B 43/123* (2013.01)

(58) Field of Classification Search
CPC ..... E21B 33/1208; E21B 43/123
See application file for complete search history.

(56) References Cited

U.S. PATENT DOCUMENTS

| | | | |
|---|---|---|---|
| 1,525,740 | A | 2/1925 | Howard |
| 2,075,912 | A | 4/1937 | Roye |
| 2,590,931 | A | 4/1952 | Cabaniss |
| 2,743,781 | A | 5/1956 | Lane |
| 2,865,454 | A | 12/1958 | Richards |
| 3,206,536 | A | 9/1965 | Goodloe |
| 3,371,716 | A | 3/1968 | Current |
| 3,616,354 | A | 10/1971 | Russell |
| 3,706,125 | A | 12/1972 | Hopkins |
| 4,270,608 | A | 6/1981 | Hendrickson |
| 4,424,859 | A | 1/1984 | Sims |
| 4,424,861 | A | 1/1984 | Carter |
| 4,442,908 | A | 4/1984 | Steenbock |
| 4,446,932 | A | 5/1984 | Hipp |
| 4,457,379 | A | 7/1984 | McStravick |

(Continued)

FOREIGN PATENT DOCUMENTS

| | | | |
|---|---|---|---|
| CA | 2820742 | A1 | 9/2013 |
| CN | 203308412 | U | 11/2013 |

(Continued)

OTHER PUBLICATIONS

Murphy et al. "The Effect of Changes in Hydraulic Fracking Fluid Chemistries on the Dissolution Rate of Dissolvable Magnesium Frack Plug Components." Paper presented at the SPE Annual Technical Conference and Exhibition, Calgary, Alberta, Canada, Sep. 2019. doi: https://doi.org/10.2118/195987-MS (Year: 2019).*

(Continued)

*Primary Examiner* — Theodore N Yao
(74) *Attorney, Agent, or Firm* — Scott Richardson; Parker Justiss, P.C.

(57) ABSTRACT

Disclosed herein are aspects of a gas lift mandrel plug for use in a wellbore. In one embodiment, a gas lift mandrel plug may comprise an elongate member having a proximal end and a distal end, wherein the elongate member comprises a metal sealant configured to expand in response to hydrolysis, and wherein the elongate member is configured to seal a side pocket of a wellbore tubular in response to hydrolysis.

19 Claims, 3 Drawing Sheets

(56) References Cited

U.S. PATENT DOCUMENTS 4,527,815 A 7/1985 Frick
4,977,636 A 12/1990 King
4,979,585 A 12/1990 Chesnutt
5,139,274 A 8/1992 Oseman
5,220,959 A 6/1993 Vance
5,424,139 A 6/1995 Shuler
5,492,173 A 2/1996 Kilgore
5,517,981 A 5/1996 Taub et al.
5,662,341 A 9/1997 Ezell et al.
5,667,015 A 9/1997 Harestad
5,803,173 A 9/1998 Fraser et al.
6,089,320 A 7/2000 LaGrange
6,106,024 A 8/2000 Herman et al.
6,840,325 B2 1/2005 Stephenson
6,907,930 B2 6/2005 Cavender
6,942,039 B2 9/2005 Tinker
7,104,322 B2 9/2006 Whanger et al.
7,152,687 B2 12/2006 Gano
7,322,408 B2 1/2008 Howlett
7,347,274 B2 3/2008 Patel
7,350,590 B2 4/2008 Hosie et al.
7,402,277 B2 7/2008 Ayer
7,578,043 B2 8/2009 Simpson et al.
7,673,688 B1 3/2010 Jones
7,677,303 B2 3/2010 Coronado
7,696,275 B2 4/2010 Slay et al.
7,963,321 B2 6/2011 Kutac
7,996,945 B2 8/2011 Nosker
8,042,841 B2 10/2011 Viegener
8,109,339 B2 2/2012 Xu
8,225,861 B2 7/2012 Foster et al.
8,266,751 B2 9/2012 He
8,430,176 B2 4/2013 Xu
8,453,736 B2 6/2013 Constantine
8,459,367 B2 6/2013 Nutley et al.
8,469,084 B2 6/2013 Clark et al.
8,490,707 B2 7/2013 Robisson
8,579,024 B2 11/2013 Mailand et al.
8,684,096 B2 4/2014 Harris
8,794,330 B2 8/2014 Stout
8,807,209 B2 8/2014 King
8,875,800 B2 11/2014 Wood et al.
8,894,070 B2 11/2014 Bhat et al.
8,993,491 B2 3/2015 James
9,004,173 B2 4/2015 Richard
9,217,311 B2 12/2015 Slup
9,249,904 B2 2/2016 Duquette
9,279,295 B2 3/2016 Williamson et al.
9,347,272 B2 5/2016 Hewson et al.
9,353,606 B2 5/2016 Bruce et al.
9,393,601 B2 7/2016 Ranck
9,404,030 B2 8/2016 Mazyar
9,534,460 B2 1/2017 Watson et al.
9,611,715 B1 4/2017 Smith
9,644,459 B2 5/2017 Themig
9,708,880 B2 7/2017 Solhaug
9,725,979 B2 8/2017 Mazyar et al.
9,732,578 B2 8/2017 McRobb
9,745,451 B2 8/2017 Zhao et al.
9,765,595 B2 9/2017 Themig et al.
9,771,510 B2 9/2017 James et al.
9,850,738 B2 * 12/2017 Frazier ..... E21B 33/134
9,945,190 B2 4/2018 Crowley
9,976,380 B2 5/2018 Davis et al.
9,976,381 B2 5/2018 Martin et al.
10,030,467 B2 7/2018 Al-Gouhi
10,060,225 B2 8/2018 Wolf
10,119,011 B2 11/2018 Zhao et al.
10,179,873 B1 1/2019 Meng
10,316,601 B2 6/2019 Walton et al.
10,337,298 B2 7/2019 Braddick
10,344,570 B2 7/2019 Steele
10,352,109 B2 7/2019 Sanchez
10,364,636 B2 7/2019 Davis
10,472,933 B2 11/2019 Steele
10,533,392 B2 1/2020 Walton et al.
10,718,183 B2 7/2020 Bruce et al.
10,758,974 B2 9/2020 Sherman
10,794,152 B2 10/2020 Lang et al.
10,961,804 B1 3/2021 Fripp
11,359,448 B2 6/2022 Fripp
11,365,611 B2 6/2022 Gibb
11,428,066 B2 8/2022 Andersen
11,512,552 B2 11/2022 Fripp
2002/0088616 A1 7/2002 Swor et al.
2003/0132001 A1 7/2003 Wilson
2003/0164236 A1 9/2003 Thornton
2003/0164237 A1 9/2003 Butterfield, Jr.
2003/0205377 A1 11/2003 Streater
2004/0194970 A1 10/2004 Eatwell
2005/0051333 A1 3/2005 Weber
2005/0061369 A1 * 3/2005 De Almeida ..... E21B 43/123 137/155
2005/0072576 A1 4/2005 Henriksen
2005/0093250 A1 5/2005 Santi et al.
2005/0199401 A1 9/2005 Patel et al.
2006/0144591 A1 7/2006 Gonzalez
2006/0272806 A1 12/2006 Wilkie et al.
2007/0089875 A1 4/2007 Steele et al.
2007/0089910 A1 4/2007 Hewson et al.
2007/0095532 A1 5/2007 Head
2007/0137826 A1 6/2007 Bosma et al.
2007/0144734 A1 6/2007 Xu et al.
2007/0151724 A1 7/2007 Ohmer et al.
2007/0163781 A1 7/2007 Walker
2007/0221387 A1 9/2007 Levy
2007/0246213 A1 10/2007 Hailey
2007/0267824 A1 11/2007 Baugh et al.
2007/0277979 A1 12/2007 Todd et al.
2008/0047708 A1 2/2008 Spencer
2008/0135249 A1 6/2008 Fripp
2008/0149351 A1 * 6/2008 Marya ..... E21B 41/00 166/387
2008/0290603 A1 11/2008 Laflin
2009/0014173 A1 1/2009 Macleod
2009/0084555 A1 4/2009 Lee
2009/0102133 A1 4/2009 Ruddock
2009/0159278 A1 6/2009 Corre
2009/0200028 A1 8/2009 Dewar
2009/0250227 A1 * 10/2009 Brown ..... E21B 33/10 166/386
2009/0250228 A1 10/2009 Loretz
2009/0272546 A1 11/2009 Nutley et al.
2009/0321087 A1 12/2009 Victorov
2010/0072711 A1 3/2010 Doane
2010/0078173 A1 4/2010 Buytaert et al.
2010/0096143 A1 4/2010 Angman
2010/0108148 A1 5/2010 Chen
2010/0122819 A1 * 5/2010 Wildman ..... E21B 43/123 166/386
2010/0139930 A1 6/2010 Patel
2010/0155083 A1 6/2010 Lynde et al.
2010/0181080 A1 7/2010 Levy
2010/0225107 A1 9/2010 Tverlid
2010/0257913 A1 10/2010 Storm, Jr. et al.
2010/0307737 A1 12/2010 Mellemstrand
2011/0061876 A1 3/2011 Johnson et al.
2011/0098202 A1 * 4/2011 James ..... C04B 26/02 507/225
2011/0147014 A1 6/2011 Chen et al.
2012/0018143 A1 1/2012 Lembcke
2012/0048531 A1 3/2012 Marzouk
2012/0048561 A1 3/2012 Holderman
2012/0048623 A1 3/2012 Lafuente et al.
2012/0049462 A1 3/2012 Pitman
2012/0168147 A1 7/2012 Bowersock
2012/0175134 A1 7/2012 Robisson
2012/0273236 A1 11/2012 Gandikota et al.
2013/0048289 A1 2/2013 Mazyar et al.
2013/0056207 A1 3/2013 Wood et al.
2013/0081815 A1 4/2013 Mazyar et al.
2013/0152824 A1 6/2013 Crews
2013/0153236 A1 6/2013 Bishop
2013/0161006 A1 6/2013 Robisson et al.

(56) References Cited

U.S. PATENT DOCUMENTS

2013/0186615 A1 7/2013 Hallunbaek et al.
2013/0192853 A1 8/2013 Themig
2013/0292117 A1 11/2013 Robisson
2014/0026335 A1 1/2014 Smith
2014/0034308 A1 2/2014 Holderman
2014/0051612 A1 2/2014 Mazyar
2014/0246209 A1* 9/2014 Themig ..... E21B 23/004 166/194
2014/0262352 A1 9/2014 Lembcke
2015/0021049 A1 1/2015 Davis et al.
2015/0075768 A1 3/2015 Wright et al.
2015/0101813 A1 4/2015 Zhao
2015/0113913 A1 4/2015 Kim
2015/0184486 A1 7/2015 Epstein
2015/0233190 A1 8/2015 Wolf et al.
2015/0275587 A1 10/2015 Wolf et al.
2015/0337615 A1 11/2015 Epstein et al.
2015/0345248 A1 12/2015 Carragher
2015/0368990 A1 12/2015 Jewett
2015/0369003 A1 12/2015 Hajjari et al.
2016/0024896 A1 1/2016 Johnson et al.
2016/0024902 A1 1/2016 Richter
2016/0137912 A1 5/2016 Sherman et al.
2016/0138359 A1 5/2016 Zhao
2016/0145488 A1 5/2016 Aines et al.
2016/0145968 A1 5/2016 Marya
2016/0177668 A1 6/2016 Watson et al.
2016/0194936 A1 7/2016 Allen
2016/0208569 A1* 7/2016 Anderson ..... E21B 43/123
2016/0230495 A1 8/2016 Mazyar et al.
2016/0273312 A1 9/2016 Steele et al.
2016/0319633 A1 11/2016 Cooper et al.
2016/0326830 A1 11/2016 Hallundbaek
2016/0326849 A1 11/2016 Bruce
2016/0333187 A1 11/2016 Bauer et al.
2017/0015824 A1 1/2017 Gozalo
2017/0022778 A1 1/2017 Fripp et al.
2017/0107419 A1 4/2017 Roy et al.
2017/0107794 A1 4/2017 Steele
2017/0113275 A1 4/2017 Roy et al.
2017/0159401 A1 6/2017 Saltel et al.
2017/0175487 A1 6/2017 Marcin et al.
2017/0175488 A1 6/2017 Lisowski
2017/0191342 A1 7/2017 Turley
2017/0198191 A1 7/2017 Potapenko
2017/0234103 A1 8/2017 Frazier
2017/0306714 A1 10/2017 Haugland
2017/0314372 A1 11/2017 Tolman
2017/0350237 A1 12/2017 Giem et al.
2017/0356266 A1 12/2017 Arackakudiyil
2018/0023362 A1 1/2018 Makowiecki et al.
2018/0023366 A1 1/2018 Deng et al.
2018/0038193 A1 2/2018 Walton
2018/0080304 A1 3/2018 Cortez et al.
2018/0081468 A1 3/2018 Bruce et al.
2018/0086894 A1 3/2018 Roy
2018/0087350 A1* 3/2018 Sherman ..... E21B 43/086
2018/0094508 A1 4/2018 Smith et al.
2018/0100367 A1 4/2018 Perez
2018/0128072 A1 5/2018 Larsen
2018/0128082 A1 5/2018 Hollan et al.
2018/0209234 A1 7/2018 Manera
2018/0223624 A1 8/2018 Fripp
2018/0298708 A1 10/2018 Schmidt et al.
2018/0334607 A1* 11/2018 Paxson ..... E21B 33/12
2018/0334882 A1 11/2018 Brandsdal
2018/0347288 A1 12/2018 Fripp
2018/0363409 A1 12/2018 Frazier
2019/0016951 A1 1/2019 Sherman et al.
2019/0032435 A1 1/2019 Kochanek et al.
2019/0039126 A1 2/2019 Sherman
2019/0078414 A1 3/2019 Frazier
2019/0128092 A1 5/2019 Mueller et al.
2019/0136666 A1 5/2019 Kent
2019/0178054 A1 6/2019 Bruce
2019/0186228 A1 6/2019 Beckett et al.
2019/0225861 A1 7/2019 Reddy
2019/0249510 A1 8/2019 Deng et al.
2019/0316025 A1 10/2019 Sherman
2019/0383115 A1 12/2019 Lees
2020/0032574 A1 1/2020 Fripp et al.
2020/0056435 A1 2/2020 Sherman
2020/0072019 A1 3/2020 Onti et al.
2020/0080401 A1 3/2020 Sherman
2020/0080402 A1 3/2020 Lang et al.
2020/0157912 A1* 5/2020 Mhaskar ..... E21B 33/1208
2020/0240235 A1 7/2020 Fripp et al.
2020/0308945 A1 10/2020 Surjaatmadja et al.
2020/0325749 A1 10/2020 Fripp et al.
2020/0362224 A1 11/2020 Wellhoefer
2020/0370391 A1 11/2020 Fripp et al.
2021/0017835 A1 1/2021 Pelto et al.
2021/0040810 A1 2/2021 Evers
2021/0123310 A1 4/2021 Fripp et al.
2021/0123319 A1 4/2021 Greci
2021/0172286 A1 6/2021 Barlow
2021/0187604 A1 6/2021 Sherman et al.
2021/0270093 A1 9/2021 Fripp
2021/0270103 A1 9/2021 Greci et al.
2021/0332673 A1 10/2021 Fripp
2021/0363849 A1 11/2021 Al Yahya
2022/0106847 A1 4/2022 Dahl
2022/0186575 A1 6/2022 Fripp
2022/0205336 A1 6/2022 Asthana
2022/0372837 A1 11/2022 Holderman et al.

FOREIGN PATENT DOCUMENTS

CN 205422632 U 8/2016
CN 107148444 A 9/2017
CN 108194756 A 6/2018
CN 107148444 B 1/2019
CN 108194756 B 8/2020
EP 15726 A1 9/1980
EP 869257 A2 10/1998
EP 940558 A1 9/1999
EP 0940558 B1 1/2005
EP 1757770 A1 2/2007
EP 1910728 A1 4/2008
EP 1910728 B1 9/2009
EP 2447466 A2 5/2012
EP 2501890 A2 9/2012
EP 2501890 B 7/2014
EP 2447466 A3 3/2017
EP 3144018 A1 3/2017
EP 3144018 A4 5/2017
EP 3196402 A1 7/2017
EP 3144018 B1 9/2018
EP 2447466 B1 10/2018
GB 2444060 A 5/2008
GB 2444060 B 12/2008
JP 2003090037 A 3/2003
JP 2003293354 A 10/2003
JP 2004169303 A 6/2004
JP 2015175449 A 10/2015
KR 20020014619 A 2/2002
KR 20080096576 A 10/2008
WO 02/02900 A2 1/2002
WO 02/02900 A3 5/2002
WO 02/02900 A8 12/2003
WO 2005/022012 A1 3/2005
WO 2006/045794 A1 5/2006
WO 2007/047089 A1 4/2007
WO 2012/094322 A2 7/2012
WO 2012/125660 A2 9/2012
WO 2012/094322 A3 10/2012
WO 2012/125660 A3 2/2013
WO 2014/028149 A1 2/2014
WO 2014/182301 A1 11/2014
WO 2014/193042 A1 12/2014
WO 2015/057338 A1 4/2015
WO 2015/069886 A2 5/2015
WO 2015/069886 A3 9/2015
WO 2015/183277 A1 12/2015

(56) References Cited

FOREIGN PATENT DOCUMENTS

| | | | |
|---|---|---|---|
| WO | 2016/000068 | A1 | 1/2016 |
| WO | 2016/171666 | A1 | 10/2016 |
| WO | 2017/100417 | A1 | 6/2017 |
| WO | 2018/055382 | A1 | 3/2018 |
| WO | 2019/094044 | A1 | 5/2019 |
| WO | 2019/122857 | A1 | 6/2019 |
| WO | 2019/147285 | A1 | 8/2019 |
| WO | 2019/151870 | A1 | 8/2019 |
| WO | 2019/164499 | A1 | 8/2019 |
| WO | 2020/005252 | A1 | 1/2020 |
| WO | 2020/141203 | A1 | 7/2020 |
| WO | 2019/164499 | A8 | 8/2020 |
| WO | 2020/167288 | A1 | 8/2020 |
| WO | 2020/204940 | A1 | 10/2020 |
| WO | 2021/034325 | A1 | 2/2021 |
| WO | 2021/086317 | A1 | 5/2021 |
| WO | 2021/096519 | A1 | 5/2021 |
| WO | 2021/126279 | A1 | 6/2021 |

OTHER PUBLICATIONS

Tu, Huilin, Aviles, Isaac, and Michael Dardis. "Degradable Materials for Multi-Stage Stimulation." Paper presented at the Offshore Technology Conference, Houston, Texas, May 2019. doi: https://doi.org/10.4043/29282-MS (Year: 2019).*

International Labor Organization (ILO). Calcium Oxide. ICSC:0409 (Sep. 1997). CAS# 1305-78-8 (Year: 1997).*

Fripp, et al. "Novel Expanding Metal Alloy for Non-Elastomeric Sealing and Anchoring." Paper presented at the SPE Annual Technical Conference and Exhibition, Houston, Texas, USA, Oct. 2022. doi: https://doi.org/10.2118/210273-MS (Year: 2022).*

* cited by examiner

EXPANDABLE METAL GAS LIFT MANDREL PLUG

CROSS-REFERENCE TO RELATED APPLICATION

This application claims the benefit of International Application Number PCT/US2019/045301, filed Aug. 6, 2019, entitled "EXPANDABLE METAL GAS LIFT MANDREL PLUG," commonly assigned with this application.

BACKGROUND

To obtain hydrocarbon fluids from a formation within the earth, a wellbore is drilled into the earth to intersect an area of interest within the formation. The wellbore may then be "completed" by inserting casing within the wellbore and setting the casing therein using cement. In the alternative, the wellbore may remain uncased (an "open hole wellbore"), or may become only partially cased. Regardless of the form of the wellbore, production tubing is typically run into the wellbore primarily to convey production fluid (e.g., hydrocarbon fluid, which may also include water) from the area of interest within the wellbore to the surface of the wellbore.

Often, pressure within the wellbore is insufficient to cause the production fluid to naturally rise through the production tubing to the surface of the wellbore. Thus, to carry the production fluid from the area of interest within the wellbore to the surface of the wellbore, artificial lift means are sometimes necessary.

One artificial lift means is a gas lift system. Gas lift systems typically include several gas lift valves, which are often internal one-way valves spaced in a gas lift mandrel located in the inner diameter of the production tubing. The gas lift valves allow fluid flow from an annulus between the casing and the production tubing to lift production fluid flowing through the production tubing, yet the gas lift valves prevent fluid flow from the longitudinal bore running through the production tubing into the annulus.

During the course of a gas lift operation, access to the gas lift valves by the operator is often necessary for several reasons. First, the gas lift valves often require maintenance, repair, or replacement, for example if the valve is leaking fluid flow into the annulus from the production tubing. Second, it is often necessary to remove the gas lift valves, and insert a gas lift mandrel plug in their place. Unfortunately, existing gas lift mandrel plugs experience certain drawbacks, particularly with efficiently plugging eroded gas lift mandrels. Accordingly, what is needed in the art is an improved gas lift mandrel plug that does not experience the drawbacks of those that currently exist.

BRIEF DESCRIPTION

Reference is now made to the following descriptions taken in conjunction with the accompanying drawings, in which.

DETAILED DESCRIPTION

Figure 1:
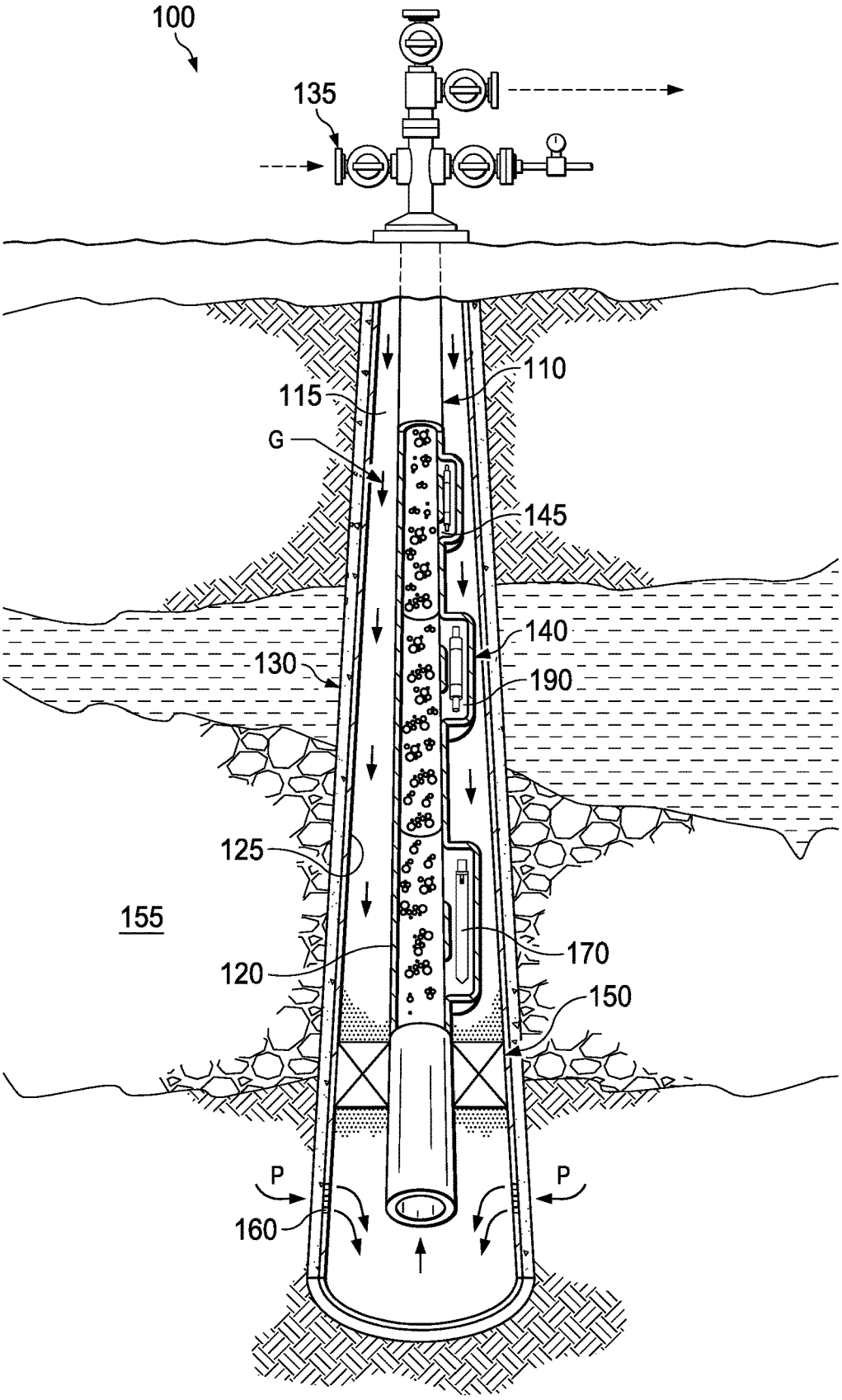
FIG. 1 is a perspective view of a well system employing a gas lift mandrel plug according to the disclosure.

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

Referring to FIG. 1, depicted is a well system 100 including an exemplary operating environment that the apparatuses, systems and methods disclosed herein may be employed. For example, the well system 100 could use a gas lift mandrel plug according to any of the embodiments, aspects, applications, variations, designs, etc. disclosed in the following paragraphs. The well system 100 includes a typical gas lift system 110, as shown in FIG. 1. Generally, compressed gas G is injected into an annulus 115 between an outer diameter of a wellbore tubular (e.g., production tubing string 120) and the inner diameter of casing 125 within the wellbore 130. A valve system 135 supplies injection gas G and allows produced fluid to exit the gas lift system 110.

Spaced within the production tubing string 120 are gas lift mandrels 140 having gas lift valves 145 within side pockets 190 thereof. In the illustrated embodiment, the side pockets 190 of the gas lift mandrels 140 are offset from the centerline of the production tubing string 120. The gas lift valves 145, in the illustrated embodiment, are one-way valves used to allow gas to flow from the annulus 115 into the production tubing string 120 and to disallow gas to flow from the production tubing string 120 into the annulus 115.

A production packer 150 located at a lower end of the production tubing string 120 forces the flow of production fluid P from a reservoir or zone of interest in a subterranean formation 155 up through the production tubing string 120 instead of up through the annulus 115. Additionally, the production packer 150 forces the gas flow from the annulus 115 into the production tubing string 120 through the gas lift valves 145, as gas G is not allowed to flow further down into the annulus 115 past the production packer 150.

In operation, production fluid P flows from the subterranean formation 155 into the wellbore 130 through perforations 160 in the casing 125 and the subterranean formation 155. The production fluid P flows into the production tubing string 120. When it is desired to lift the production fluid P with gas G, compressed gas G is introduced into the annulus 115. The gas lift valves 145 allow the gas G to flow into the production tubing string 120 while preventing the flow of the production fluid P into the annulus 115 through the gas lift valves 145.

The well system 100 of FIG. 1 additionally includes a gas lift mandrel plug 170 manufactured and designed according to the disclosure. In certain situations one or more of the gas lift valves 145 need to be removed and/or the need for production gas G is no longer necessary. In such a situation, the one or more of the gas lift valves 145 may be removed from one or more of the side pockets 190, and thereafter the one or more side pockets 190 may be sealed to prevent gas, debris, or contaminants from entering the production tubing 120. In some embodiments, a gas lift mandrel plug 170 according to the disclosure may be inserted into the side pocket 190 to seal the gas lift mandrel 140. In this scenario, the gas lift valve 145 may be removed from the side pocket 190 using one or more different types of intervention tools. The gas lift mandrel plug 170 may then be connected with the intervention tool, or a different intervention tool, and deployed downhole and placed into the side pocket 190.

The gas lift mandrel plug 170, in accordance with the disclosure, may comprise a metal sealant configured to expand in response to hydrolysis, such that the gas lift mandrel plug 170 seals the side pocket 190 in response to hydrolysis. As the gas lift mandrel plug 170 expands, it may enlarge to fit within the various different surface irregularities (e.g., cracks, crevices, debris, etc.) in the side pocket 190. Additional details of the gas lift mandrel plug 170 are discussed below.

Figure 2:
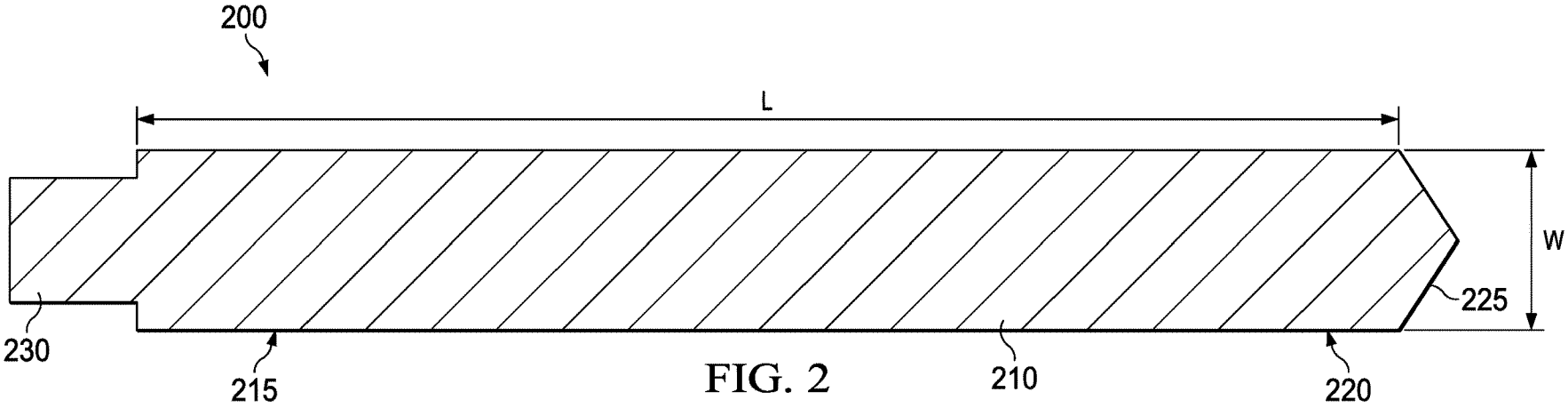
FIG. 2 is a section view of one embodiment of a gas lift mandrel plug according to the disclosure.

Turning to FIG. 2, illustrated is a gas lift mandrel plug 200 manufactured and designed in accordance with the disclosure. The gas lift mandrel plug 200 may include an elongate member 210 having a proximal end 215 and a distal end 220. The term elongate member, as used herein, is intended to include members having a length significantly greater than its width and/or diameter, and may include cross-sectional shapes including circles, ovals, polygons, irregular shapes, etc. In the particular embodiment illustrated in FIG. 2, the elongate member 210 has a generally circular cross-section, and thus is a generally cylindrical member. In some embodiments, the distal end 220 may be tapered, and in some embodiments, may include a tapered nose 225 such that the gas lift mandrel plug 200 may more easily enter a side pocket of a wellbore casing, such as side pocket 190. For example, the tapered nose 225 may reduce the surface resistance as the distal end 220 is turned radially outward to initially enter the side pocket and then again to turn vertically downhole as the gas lift mandrel plug 200 is positioned into the side pocket.

The proximal end 215 may be configured to connect with an intervention tool. In the embodiment of FIG. 2, the proximal end 215 includes an intervention tool connector 230 that forms an integral part of the elongate member 210. The intervention tool connector 230 may comprise any type of connection (e.g., threaded connection, press fit connection, shear pin connection, etc.) consistent with the disclosure. In some embodiments, the same intervention tool may be used to both remove the gas lift valve and then place the gas lift mandrel plug 200. In other embodiments, different intervention tools may be used to remove the gas lift valve and place the gas lift mandrel plug 200.

The elongate member 210 may have a length (l) and a width (w). In some embodiments, the length (l) may be about 700 mm (e.g., approximately 27.56 in) or less. In another embodiment, the length (l) may be about 610 mm (e.g., approximately 2 ft.) or less, and in yet another embodiment the length (l) may be about 322 mm (e.g., approximately 12.7 in.) or less. In some embodiments, the elongate member 210 may have a width (w) of about 51 mm (e.g., approximately 2 in.) or less. In another embodiment, the width (w) may be about 26 mm (e.g., approximately 1 in.) or less, and in yet another embodiment may be about 13 mm (e.g., approximately ½ in.) or less. The elongate member 210 may, in one embodiment, have a length (l) to width (w) ratio of greater than about 6.3 to 1. In another embodiment, the elongate member 210 may have a length (l) to width (w) ratio of less than about 48 to 1. In yet another embodiment, the elongate member 210 may have a length (l) to width (w) ratio ranging from about 12 to 1 to about 14 to 1, and in another embodiment the elongate member 210 may have a length (l) to width (w) ratio ranging from about 12.25 to 1 to about 12.5 to 1.

In some embodiments, all or part of the gas lift mandrel plug 200 may be fabricated using an expanding metal sealant configured to expand in response to hydrolysis. The expanding metal sealant, in some embodiments, may be described as expanding to a cement like material that seals a gas lift valve in a side pocket of a side pocket mandrel, such as, e.g. side pocket mandrel 140 shown in FIG. 1. In other words, the metal goes from metal to micron-scale particles and then these particles lock together to, in essence, seal the gas lift mandrel. The reaction may, in certain embodiments, occur in less than 2 days in a reactive fluid and in downhole temperatures. Nevertheless, the time of reaction may vary depending on the reactive fluid.

In some embodiment the reactive fluid may be a brine solution such as may be produced during well completion activities, and in other embodiments, the reactive solution may be one of the additional solutions discussed herein. The metal, pre-expansion, is electrically conductive in certain embodiments. The metal may be machined to any specific size/shape, extruded, formed, cast or other conventional ways to get the desired shape of a metal. Metal, pre-expansion, in certain embodiments has a yield strength greater than about 8,000 psi, e.g., 8,000 psi+/−50%. The metal, in this embodiment, has a minimum dimension greater than about 1.25 mm (e.g., approximately 0.05 inches).

The hydrolysis of any metal can create a metal hydroxide. The formative properties of alkaline earth metals (Mg—Magnesium, Ca—Calcium, etc.) and transition metals (Zn—Zinc, Al—Aluminum, etc.) under hydrolysis reactions demonstrate structural characteristics that are favorable for use with the present disclosure. Hydration results in an increase in size from the hydration reaction and results in a metal hydroxide that can precipitate from the fluid.

The hydration reactions for magnesium is:

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, and norstrandite, depending on form. The hydration reaction for aluminum is:

$$Al+3H_2O \rightarrow Al(OH)_3+3/2\ H_2.$$

Another hydration reactions uses calcium hydrolysis. The hydration reaction for calcium is:

$$Ca+2H_2O \rightarrow Ca(OH)_2+H_2,$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide, which has solubility in strong acids or in strong bases.

In an embodiment, the metallic material used can be a metal alloy. The metal alloy can be an alloy of the base metal with other elements in order to either adjust the strength of the metal alloy, to adjust the reaction time of the metal alloy, or to adjust the strength of the resulting metal hydroxide byproduct, among other adjustments. The metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the alloy can be alloyed with a dopant that promotes corrosion, such as Ni—Nickel, Fe—Iron, Cu—Copper, Co—Cobalt, Ir—Iridium, Au—Gold, C—Carbon, gallium, indium, mercury, bismuth, tin, and Pd—Palladium. The metal alloy can be constructed in a solid solution process where the elements are combined with molten metal or metal alloy. Alternatively, the metal alloy could be constructed with a powder metallurgy process. The metal can be cast, forged, extruded, or a combination thereof.

Optionally, non-expanding components may be added to the starting metallic materials. For example, ceramic, elastomer, glass, or non-reacting metal components can be embedded in the expanding metal or coated on the surface of the metal. Alternatively, the starting metal may be the metal oxide. For example, calcium oxide (CaO) with water will produce calcium hydroxide in an energetic reaction. Due to the higher density of calcium oxide, this can have a 260% volumetric expansion where converting 1 mole of CaO goes from 9.5 cc to 34.4 cc of volume. In one variation, the expanding metal is formed in a serpentinite reaction, a hydration and metamorphic reaction. In one variation, the resultant material resembles a mafic material. Additional ions can be added to the reaction, including silicate, sulfate, aluminate, and phosphate. The metal can be alloyed to increase the reactivity or to control the formation of oxides.

Figure 3:
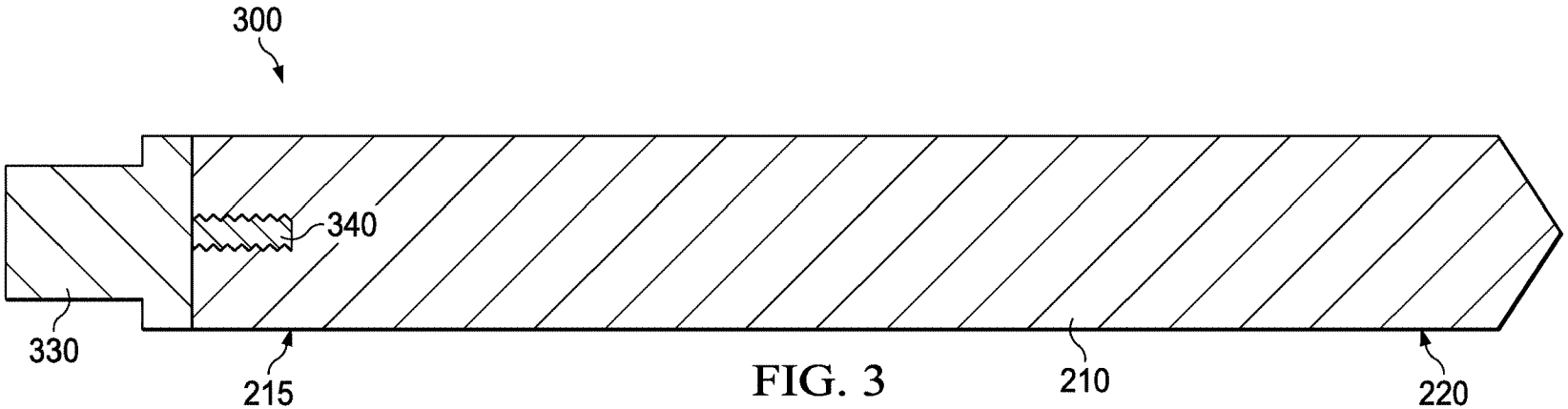
FIG. 3 is a section view of another embodiment of a gas lift mandrel plug according to the disclosure.

Referring now FIG. 3, there is shown another embodiment of a gas lift mandrel plug 300 according to the disclosure. The gas lift mandrel plug 300 may include an elongate member 210 having a proximal end 215 and a distal end 220. In this embodiment, the proximal end 215 includes an intervention tool connector 330. In the illustrated embodiment of FIG. 3, the intervention tool connector 330 is not integrally manufactured with the elongate member 210, and thus is coupled with the elongate member 210 via threaded connection 340, among other available connections. The intervention tool connector 330, in this embodiment, might comprise a material different from the elongate member 210, and more particularly a material that does not expand as a result of hydrolysis.

Figure 4:
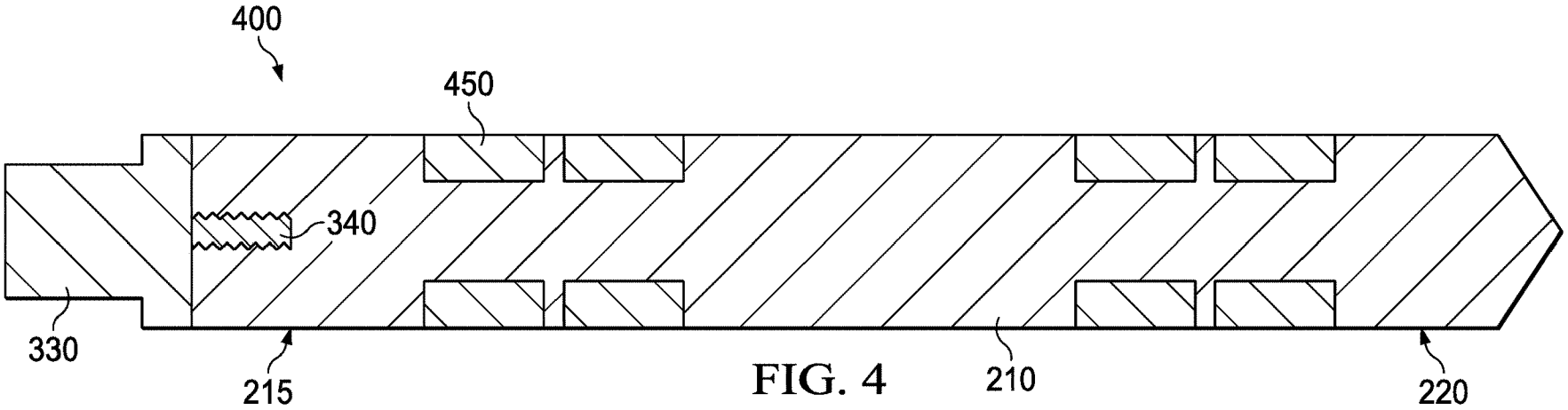
FIG. 4 is a section view of yet another embodiment of a gas lift mandrel plug according to the disclosure.

Referring now to FIG. 4, there is shown yet another embodiment of a gas lift mandrel plug 400 according to the disclosure. The gas lift mandrel plug 400 may include an elongate member 210 having a proximal end 215 and a distal end 220. The proximal end 215 includes an intervention tool connector 330, which in this embodiment is coupled with the elongate member 210 via threaded connection 340. One or more swellable members 450 may be coupled radially about the elongate member 210. The swellable members 450 may comprise a swellable rubber that is configured to expand in response to contact with one or more different types of fluids. In one embodiment, the reactive fluid may be a diesel solution or other water-based solutions discussed herein. The elongate member 210 may comprise a metal sealant configured to expand in response to hydrolysis. In some embodiments, the metal sealant may react with a brine solution, or the other solutions discussed above may be used.

Figure 5:
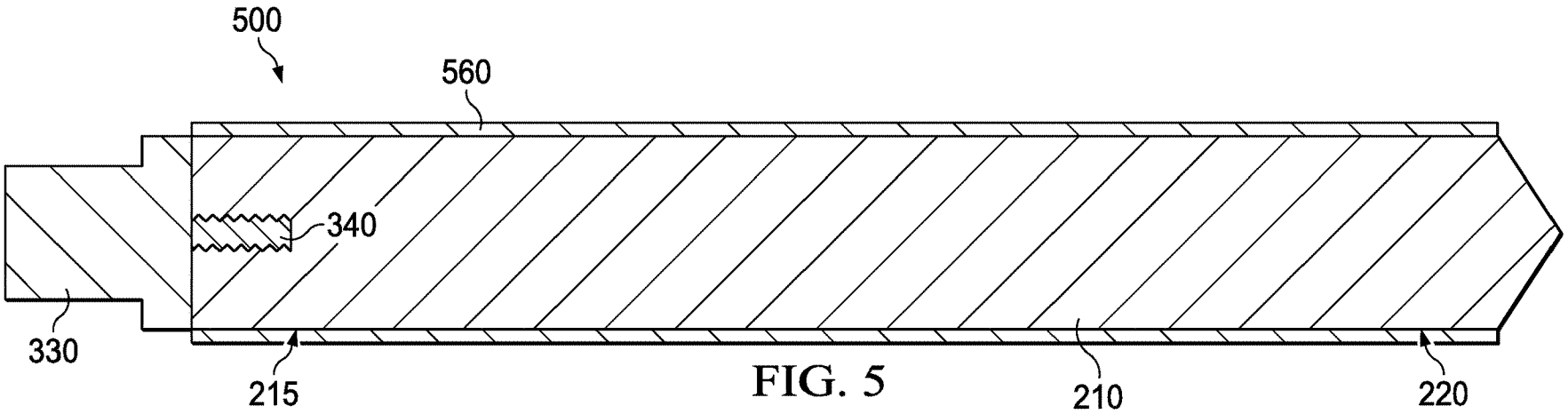
FIG. 5 is a section view of another embodiment of a gas lift mandrel plug according to the disclosure.

Referring now to FIG. 5, there is shown yet another embodiment of a gas lift mandrel plug 500 according to the disclosure. The gas lift mandrel plug 500 may include an elongate member 210 having a proximal end 215 and a distal end 220. In this embodiment, the proximal end 215 includes an intervention tool connector 330 which may be coupled with the elongate member 210 via threaded connection 340. The elongate member 210, in this embodiment, may be radially surrounded by a sleeve 560. The sleeve 560 may be employed for one or more different reasons. In one situation, the sleeve 560 is a swellable rubber sleeve configured to expand in response to contact with one or more different types of fluids. In one embodiment, the reactive fluid may be a diesel solution, and the sleeve 560 swells to further seal the gas lift mandrel. In another situation, the sleeve 560 is configured to delay the expansion of the elongate member 210, for example by providing a temporary barrier between the elongate member 210 and the hydrolysis solution.

Aspects disclosed herein include:

A. A gas lift mandrel plug for use in a wellbore. The gas lift mandrel plug, in one embodiment, includes an elongate member having a proximal end and a distal end; wherein the elongate member comprises a metal sealant configured to expand in response to hydrolysis; and wherein the elongate member is configured to seal a side pocket of a wellbore tubular in response to hydrolysis.

B. A well system. In one embodiment, the well system includes a wellbore tubular; a side pocket located within the wellbore tubular; a gas lift mandrel plug positioned in and sealing the side pocket, the gas lift mandrel plug comprising: an elongate member having a proximal end and a distal end, wherein the proximal end is configured to connect with an intervention tool; and wherein the elongate member comprises a metal sealant configured to expand in response to hydrolysis.

C. A method of using a gas lift mandrel plug in a well system. The method, in one embodiment, includes removing a gas lift valve from a side pocket located within a wellbore tubular; positioning a gas lift mandrel plug into the side pocket, the gas lift mandrel plug comprising an elongate member having a proximal end and a distal end, wherein the proximal end is configured to connect with an intervention tool; wherein the elongate member comprises a metal sealant configured to expand in response to hydrolysis; and wherein the elongate member is configured to seal a side pocket of a downhole casing in response to hydrolysis.

Aspects A, B, and C may have one or more of the following additional elements in combination: Element 1: wherein the distal end is tapered; Element 2: wherein the proximal end includes an intervention tool connector; Element 3: wherein the intervention tool connector is threadedly attached with the elongate member; Element 4: wherein the intervention tool connector forms an integral part of the elongate member; Element 5: wherein the elongate member is a cylindrical member, and further wherein a ratio of a length (l) to width (w) of the cylindrical member ranges from about 12 to 1 to about 14 to 1; Element 6: wherein a length (l) of the elongate member is less than 700 mm; Element 7: wherein the metal sealant is configured to expand in response to one of magnesium hydrolysis, aluminum hydrolysis, calcium hydrolysis, and calcium oxide hydrolysis; Element 8: wherein the metal sealant is a magnesium alloy or a magnesium alloy alloyed with at least one of Al, Zn, Mn, Zr, Y, Nd, Gd, Ag, Ca, Sn, and Re; Element 9: further comprising a swellable rubber element placed radially about the elongate member; Element 10: further including subjecting the gas lift mandrel plug to a hydrolysis fluid, the hydrolysis fluid expanding the elongate member to seal the side pocket; and Element 11: wherein hydrolysis forms a structure comprising one of a Brucite, Gibbsite, bayerite, and norstrandite.

Those skilled in the art to which this application relates will appreciate that other and further additions, deletions, substitutions and modifications may be made to the described embodiments.

What is claimed is:

1. A gas lift mandrel plug for use in a wellbore, comprising:

an elongate member having a proximal end and a distal end;

wherein the elongate member comprises a body of monolithic metal sealant configured to expand in response to hydrolysis, the body of monolithic metal sealant having a length substantially greater than a width; and wherein the expanded metal elongate member is configured to seal against an internal diameter of a side pocket of a wellbore tubular in response to hydrolysis, and further wherein during the expansion, the body of monolithic metal sealant is configured to go from metal to micron-scale particles that are larger and lock together.

2. The gas lift mandrel plug according to claim 1, wherein the distal end is tapered.

3. The gas lift mandrel plug according to claim 1, wherein the proximal end includes an intervention tool connector.

4. The gas lift mandrel plug according to claim 3, wherein the intervention tool connector is threadedly attached with the elongate member.

5. The gas lift mandrel plug according to claim 3, wherein the intervention tool connector forms an integral part of the elongate member.

6. The gas lift mandrel plug according to claim 1, wherein the elongate member is a cylindrical member, and further wherein a ratio of a length (l) to width (w) of the cylindrical member ranges from 12 to 1 to 14 to 1.

7. The gas lift mandrel plug according to claim 1, wherein a length (l) of the elongate member is less than 700 mm.

8. The gas lift mandrel plug according to claim 1, wherein the metal sealant is configured to expand in response to one of magnesium hydrolysis, aluminum hydrolysis, calcium hydrolysis, and calcium oxide hydrolysis.

9. The gas lift mandrel plug according to claim 1, wherein the metal sealant is a magnesium alloy alloyed with at least one of Al, Zn, Mn, Zr, Y, Nd, Gd, Ag, Ca, Sn, and Re.

10. The gas lift mandrel plug according to claim 1, further comprising a swellable rubber element placed radially about the elongate member.

11. A well system, comprising:

a wellbore tubular;

a side pocket located within the wellbore tubular;

a gas lift mandrel plug positioned in and sealing the side pocket, the gas lift mandrel plug comprising:

an elongate member having a proximal end and a distal end, wherein the proximal end is configured to connect with an intervention tool; and wherein the elongate member comprises a body of monolithic metal sealant configured to expand in response to hydrolysis, the body of monolithic metal sealant having a length substantially greater than a width, and further wherein during the expansion, the body of monolithic metal sealant is configured to go from metal to micron-scale particles that are larger and lock together.

12. The well system according to claim 11, wherein the distal end of the elongate member is tapered.

13. The well system according to claim 11, wherein the proximal end includes an intervention tool connector comprising a material that does not expand in response to hydrolysis.

14. The well system according to claim 11, further comprising a swellable rubber element placed radially about the elongate member.

15. A method of using a gas lift mandrel plug in a well system, the method comprising:

removing a gas lift valve from a side pocket located within a wellbore tubular;

positioning a gas lift mandrel plug into the side pocket, the gas lift mandrel plug comprising an elongate member having a proximal end and a distal end, wherein the proximal end is configured to connect with an intervention tool;

wherein the elongate member comprises a body of monolithic metal sealant configured to expand in response to hydrolysis, the body of monolithic metal sealant having a length substantially greater than a width; and wherein the elongate member is configured to seal a side pocket of a downhole casing in response to hydrolysis, and further wherein during the expansion, the body of monolithic metal sealant is configured to go from metal to micron-scale particles that are larger and lock together.

16. The method as recited in claim 15, further including subjecting the gas lift mandrel plug to a hydrolysis fluid, the hydrolysis fluid expanding the elongate member to seal the side pocket.

17. The method as recited in claim 15, wherein the metal sealant is configured to expand in response to one of magnesium hydrolysis, aluminum hydrolysis, calcium hydrolysis, and calcium oxide hydrolysis.

18. The method of claim 15 wherein hydrolysis forms a structure comprising one of a Brucite, Gibbsite, bayerite, and norstrandite.

19. The method as recited in claim 15, wherein the metal sealant is a magnesium alloy alloyed with at least one of Al, Zn, Mn, Zr, Y, Nd, Gd, Ag, Ca, Sn, and Re.

* * * * *